US012416138B2

(12) United States Patent
Bai et al.

(10) Patent No.: US 12,416,138 B2
(45) Date of Patent: Sep. 16, 2025

(54) FAUCET WITH LOCKING ASSEMBLY

(71) Applicant: Xiamen Lota International Co., Ltd., Fujian (CN)

(72) Inventors: Shuanglin Bai, Fujian (CN); Liming Ye, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 32 days.

(21) Appl. No.: 18/533,394

(22) Filed: Dec. 8, 2023

(65) Prior Publication Data

US 2025/0067031 A1 Feb. 27, 2025

(30) Foreign Application Priority Data

Aug. 24, 2023 (CN) ..... 202311072163.6

(51) Int. Cl.
*E03C 1/04* (2006.01)

(52) U.S. Cl.
CPC ..... *E03C 1/0401* (2013.01); *E03C 1/0402* (2013.01); *E03C 1/0403* (2013.01); *E03C 2001/0416* (2013.01); *Y10T 137/6977* (2015.04); *Y10T 137/9464* (2015.04)

(58) Field of Classification Search
CPC .... E03C 1/0401; E03C 1/0402; E03C 1/0403; E03C 2001/0416; Y10T 137/9464; Y10T 137/6977
USPC ..... 137/801, 359; 4/695
See application file for complete search history.

(56) References Cited

U.S. PATENT DOCUMENTS

| | | | | |
|---|---|---|---|---|
| 4,281,857 | A * | 8/1981 | Randall | E03C 1/0401 411/433 |
| 5,515,882 | A * | 5/1996 | Hennis | E03C 1/0401 137/359 |
| 6,138,296 | A * | 10/2000 | Baker | E03C 1/0401 4/678 |
| 7,296,588 | B1 * | 11/2007 | Hwang | F16K 3/085 4/677 |
| 7,353,838 | B2 * | 4/2008 | Schmitt | E03C 1/102 137/216 |
| 8,490,276 | B2 * | 7/2013 | Julian | E03C 1/0401 29/282 |
| 10,329,747 | B2 * | 6/2019 | Lu | E03C 1/0402 |
| 2016/0258142 | A1 * | 9/2016 | Zou | E03C 1/0402 |
| 2020/0157787 | A1 * | 5/2020 | Benstead | E03C 1/0402 |

* cited by examiner

*Primary Examiner* — John Bastianelli
(74) *Attorney, Agent, or Firm* — Cooper Legal Group, LLC

(57) ABSTRACT

A faucet comprises a faucet body and a locking assembly. The locking assembly is connected to the faucet body, and the locking assembly is configured to pass through a mounting hole of a countertop. At least part of the locking assembly is configured to be controlled to abut a lower side of the countertop, and the faucet body comprises a faucet housing, a support frame, and a valve. The support frame is disposed in the faucet housing, and the support frame is configured to be supported on an upper side of the countertop. The support frame is connected to the locking assembly, and the support frame forms a valve seat configured to be connected to the valve. The locking assembly comprises an operating member rotatably disposed on the support frame, and the operating member is configured to control the locking assembly to abut the lower side of the countertop.

18 Claims, 9 Drawing Sheets

FAUCET WITH LOCKING ASSEMBLY

RELATED APPLICATIONS

This application claims priority to Chinese patent application number 202311072163.6, filed on Aug. 24, 2023. Chinese patent application number 202311072163.6 is incorporated herein by reference.

FIELD OF THE DISCLOSURE

The present disclosure relates to the field of sanitary ware, and in particular to a faucet.

BACKGROUND OF THE DISCLOSURE

Installation of conventional faucets is usually carried out under a countertop, so it requires professionals to bend over for a long time, squat, or lie in a dark and narrow space under a basin and use a variety of special tools to complete the installation. This installation method, which requires going under the countertop for assembly and locking, is time-consuming and laborious for faucet installers.

A quick installation mechanism for a faucet on a countertop has been disclosed in the prior art, which comprises a mounting base, a screw rod, a nut, a lifting base that rises and falls as the screw rod and nut rotate relative to each other, and two lever rotating arms. The mounting base comprises an installation hole, and the screw rod is disposed on one side of the installation hole. The two lever rotating arms are pivotally connected to the lifting base. This method of installing the faucet from above the countertop makes the faucet assembly simple, and the faucet housing of the faucet can be installed to the mounting base after the mounting base and the lifting base are fixedly connected to the countertop, so it can be applied to faucets of various structures. In addition, this method only uses a single screw, occupying the smallest space in the installation hole, so that a faucet hose can pass through the installation hole smoothly. This mechanism can be used not only in the installation of the faucet on the countertop, but is also suitable for various styles of faucets and can provide a large installation space. It has the advantages of simple structure, reliability, small installation space occupied, and low cost.

However, the quick installation mechanism needs to be tightly connected to the faucet housing. Since the faucet housing needs to play a supporting role, lower strength materials or thin-walled structures cannot be used, and the overall manufacturing cost is high.

BRIEF SUMMARY OF THE DISCLOSURE

The present disclosure provides a faucet to solve the deficiencies in the background.

In order to solve the technical problem, a first technical solution of the present disclosure is as follows.

In order to solve the above technical problems, a faucet is provided. The faucet comprises a faucet body and a locking assembly. The locking assembly is connected to the faucet body, and the locking assembly is configured to pass through a mounting hole of a countertop. At least part of the locking assembly is configured to be controlled to abut a lower side of the countertop, and the faucet body comprises a faucet housing, a support frame, and a valve. The support frame is disposed in the faucet housing, and the support frame is configured to be supported on an upper side of the countertop. The support frame is connected to the locking assembly, and the support frame forms a valve seat configured to be connected to the valve. The locking assembly comprises an operating member rotatably disposed on the support frame, and the operating member is configured to control the locking assembly to abut the lower side of the countertop.

In a preferred embodiment, the locking assembly comprises a guiding base, and the guiding base is connected to a lower end of the support frame. The guiding base comprises a guiding wall extending along a vertical direction, and the guiding wall is configured to divide a lower space located under the support frame into a first space and a second space. The support frame comprises an operation space corresponding to the first space and a pipeline space corresponding to the second space, and the operating member is disposed in the first space and the operation space. A pipeline structure of the faucet is configured to pass through the second space and the pipeline space to be connected to the valve seat.

In a preferred embodiment, the support frame comprises a support base and a support body, and the support base is configured to be supported on the upper side of the countertop and is fixedly connected to the guiding base. The faucet comprises a pipeline pressing plate, and the support body comprises one or more pipeline sockets. The one or more pipeline sockets are in communication with the valve seat, and the pipeline pressing plate is configured to clamp the pipeline structure. The support body is fixedly connected to the support base to fixedly clamp the pipeline pressing plate, and when the support body is connected to the support base, the pipeline structure is correspondingly disposed in the one or more pipeline sockets.

In a preferred embodiment, the valve seat is formed on a side wall of the support frame, and the faucet comprises a valve sleeve. The valve sleeve is connected to the valve seat to form a valve cavity to accommodate the valve, and the faucet comprises a pressing lid. The pressing lid is connected to a distal end of the valve sleeve to fixedly press the valve.

In a preferred embodiment, the operating member is tubular, and an upper end of the operating member extends out of an upper end of the support frame. The upper end of the operating member is connected to an operating connector, and the operating member is hung on the faucet housing through a neck member to be configured to be rotated on the faucet housing.

In a preferred embodiment, the locking assembly comprises a guiding base, and the guiding base is connected to a lower end of the support frame. The guiding base comprises a guiding wall extending along a vertical direction, and the locking assembly comprises a connecting seat and one or more arms connected to two sides of the connecting seat. One side wall of the connecting seat is in contact with and matched with the guiding wall, and the operating member is threadedly connected to the connecting seat. The operating member is configured to be rotated to drive the connecting seat to move along the guiding wall so that the one or more arms abut the lower side of the countertop.

In a preferred embodiment, the guiding base further comprises a blocking seat connected to the guiding wall, and the one or more arms are configured to be in an unfolded state and a folded state relative to the connecting seat. The one or more arms are controlled by the operating member to approach or move away from the blocking seat, and the one or more arms are in the folded state when the one or more arms are adjacent to the blocking seat. The one or more arms are in the unfolded state when the one or more arms are moved away from the blocking seat, and a radial dimension of the one or more arms in the unfolded state is larger than the mounting hole of the countertop.

In a preferred embodiment, the one or more arms are rotatably connected to the connecting seat, and the one or more arms are divided into a long section and a short section relative to a rotation point of the one or more arms. A length of the long section is longer than a length of the short section, and the connecting seat comprises a protrusion located at a position of the connecting seat adjacent to the long section. The long section is turned over by gravity to drive a lower side of the long section to abut the protrusion so that the one or more arms are in the unfolded state, and the blocking seat comprises a blocking block. When the connecting seat is moved to be adjacent to the blocking seat, the blocking block pushes the long section so that the one or more arms are in the folded state. When the blocking block abuts the long section in the unfolded state, a distance between the blocking block and the rotation point of the one or more arms is greater than a distance between the protrusion and the rotation point of the one or more arms.

In a preferred embodiment, a lower side of the short section comprises a notch, and when the one or more arms are in the folded state, the protrusion corresponds to and is disposed in the notch.

In a preferred embodiment, the one or more arms are rotatably connected to the connecting seat, and the one or more arms are divided into a long section and a short section relative to a rotation point of the one or more arms. A length of the long section is longer than a length of the short section, and the connecting seat further comprises a protrusion located at a position of the connecting seat adjacent to the long section. The long section is turned over by gravity to drive an upper side of the short section to abut the protrusion so that the one or more arms are in the unfolded state, and the blocking seat comprises a blocking block. When the connecting seat is moved to be adjacent to the blocking seat, the blocking block pushes against the long section so that the one or more arms are in the folded state.

In a preferred embodiment, the upper side of the short section comprises a notch, and when the one or more arms are in the unfolded state, the protrusion corresponds to and is disposed in the notch.

In a preferred embodiment, the blocking seat further comprises an inclined surface, and when the one or more arms are in the folded state, the short section abuts the inclined surface.

Compared with the existing techniques, the technical solution has the following advantages.

The support frame is disposed in the faucet housing, and the support frame is configured to be supported on the upper side of the countertop. The support frame is connected to the locking assembly, and the support frame forms the valve seat configured to be connected to the valve. The locking assembly comprises an operating member rotatably disposed on the support frame, and the operating member is configured to control the locking assembly to abut the lower side of countertop. The support frame is disposed in the faucet housing and is respectively connected to the locking assembly and the valve to provide an overall support effect. A support effect of the faucet housing is weakened or the faucet housing does not play a supporting role. The faucet housing can be made of thin-walled materials or plastic, which can effectively reduce costs.

The first space corresponds to the operation space, and the operating member extends through the first space and the operation space. The pipeline structure extends through the second space and the pipeline space, and two parts of the lower space are separated from each other without interfering or affecting each other. This arrangement can effectively prevent the pipeline structure from being entangled or prevent the pipeline structure from affecting operation of the operating member. In this embodiment, the first space and the operation space are connected to form the axial channel, and the operating member is tubular and rotates around an axis of the operating member on the axial channel.

The pipeline pressing plate is fixedly clamped between the upper end surface of the support base and the lower end of the support body. The pipeline structure penetrates through the support base from the lower end of the support base and partially extends out of the upper end surface of the support base, and the entrance of the one or more pipeline sockets is located on the lower end of the support body. When the support body is correspondingly connected to the support base, the pipeline structure is plugged into the one or more pipeline sockets. During installation, the pipeline structure, guiding base, and support base can be fixedly connected together first, and then the support body and the upper end surface of the support base can be fixedly connected after being installed on the countertop, so as to synchronize achieving a connection between the pipeline structure and the support base.

DETAILED DESCRIPTION OF THE EMBODIMENTS

Figure 1:
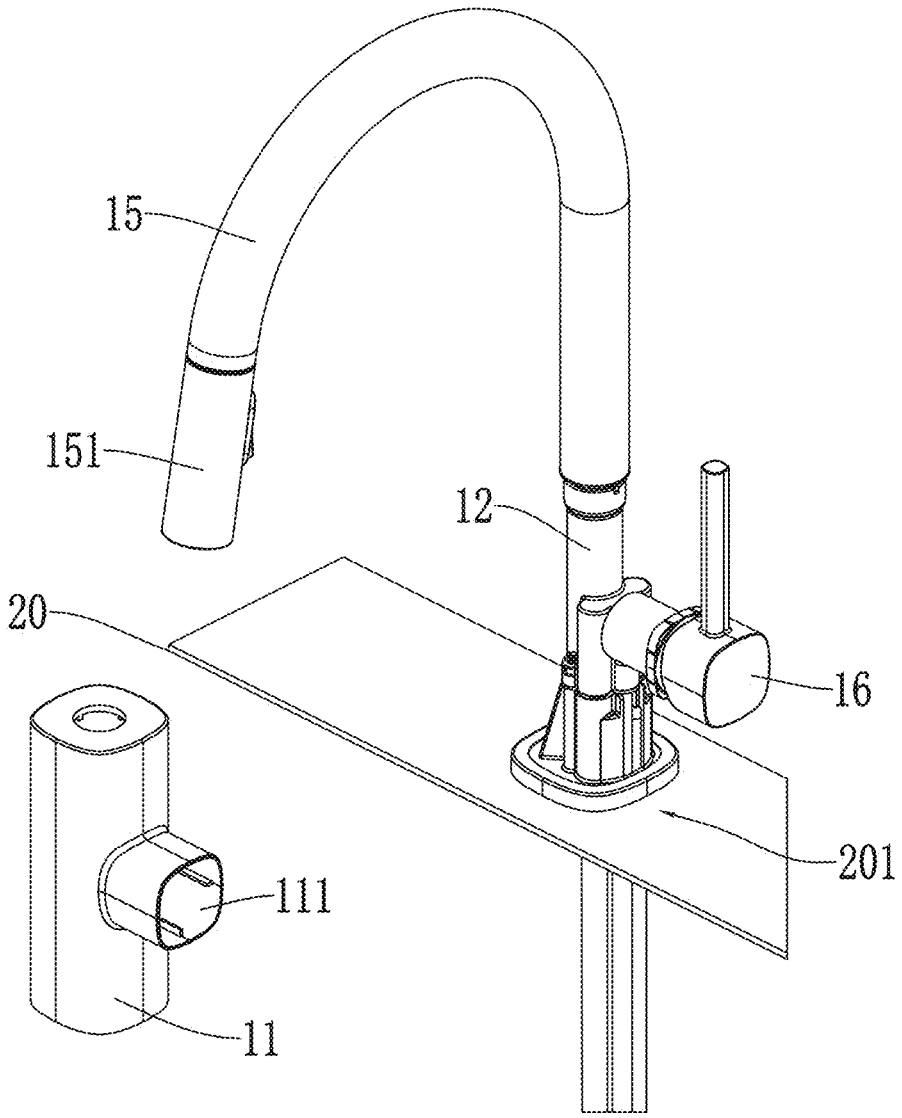
FIG. 1 is a perspective view of a faucet and a faucet housing in a preferred embodiment of the present disclosure.

The following will clearly and completely describe the technical solutions in the embodiments of the present disclosure with reference to the accompanying drawings. Obviously, the described embodiments are only a portion of the embodiments of the present disclosure, and not all of the embodiments. Based on the embodiments of the present disclosure, all other embodiments obtained by those of ordinary skill in the art without creative work fall within the protection scope of the present disclosure.

In the description of the present disclosure, it should be noted that the terms "upper", "lower", "inner", "outer", "top/bottom", etc. indicate the orientation or positional relationship based on the orientation shown in the drawings. The positional relationship is only for the convenience of describing the present disclosure and simplifying the description, rather than indicating or implying that the pointed device or element must have a specific orientation, be constructed, and be operated in a specific orientation. Therefore, the positional relationship should not be understood as a limitation of the present disclosure. In addition, the terms "first" and "second" are only used for descriptive purposes and should not be understood as indicating or implying relative importance.

In the description of the present disclosure, it should be noted that the terms "installed", "provided with", "sleeved/connected", "connected", etc., should be understood broadly. For example, "connected" can be a fixed connection, a detachable connection, or an integral connection, a mechanical connection, an electrical connection, a direct connection, or an indirect connection through an intermediate medium, and it can be a connection between two members. For those of ordinary skill in the art, the specific meaning of the above terms in the present disclosure can be understood under specific conditions.

Figure 2:
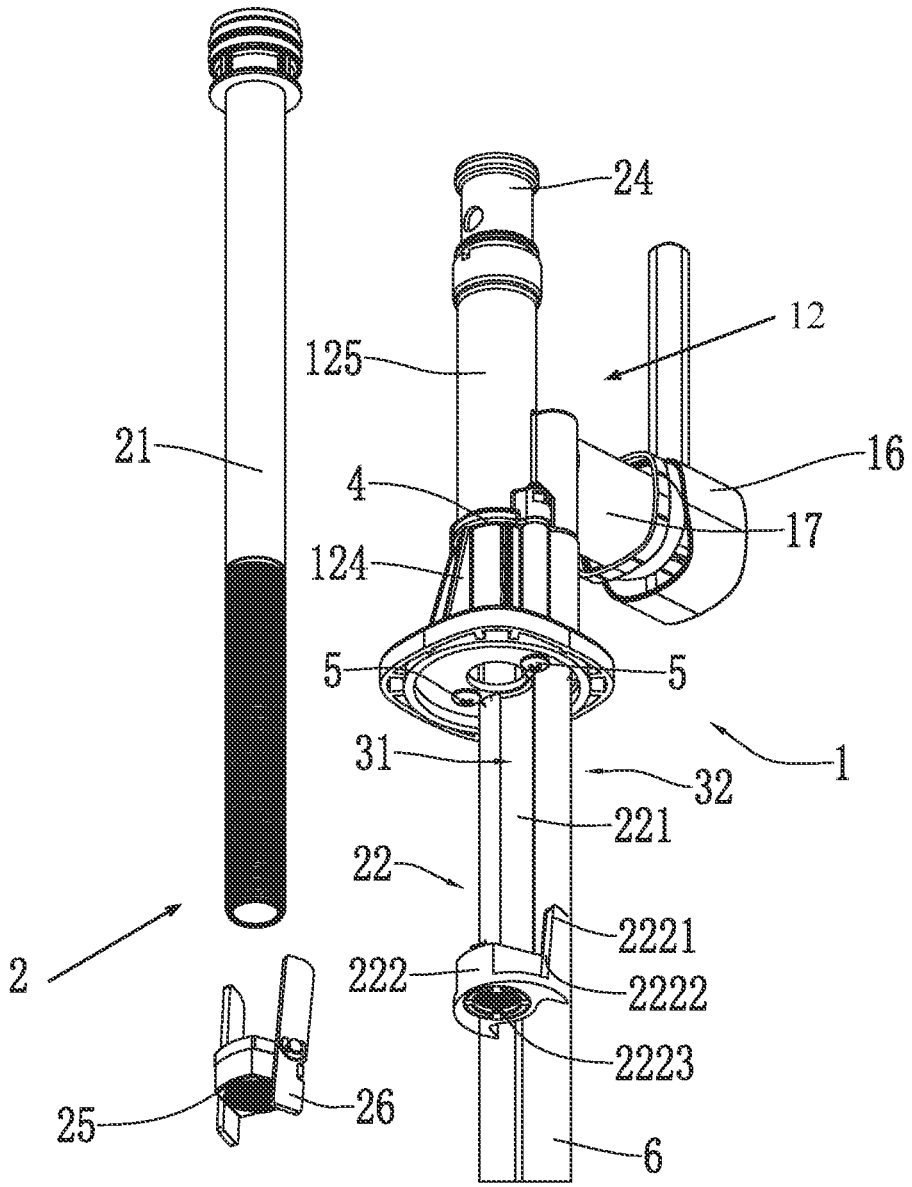
FIG. 2 is a perspective and exploded view of a locking assembly, a support frame, and other components in a preferred embodiment of the present disclosure.
Figure 3:
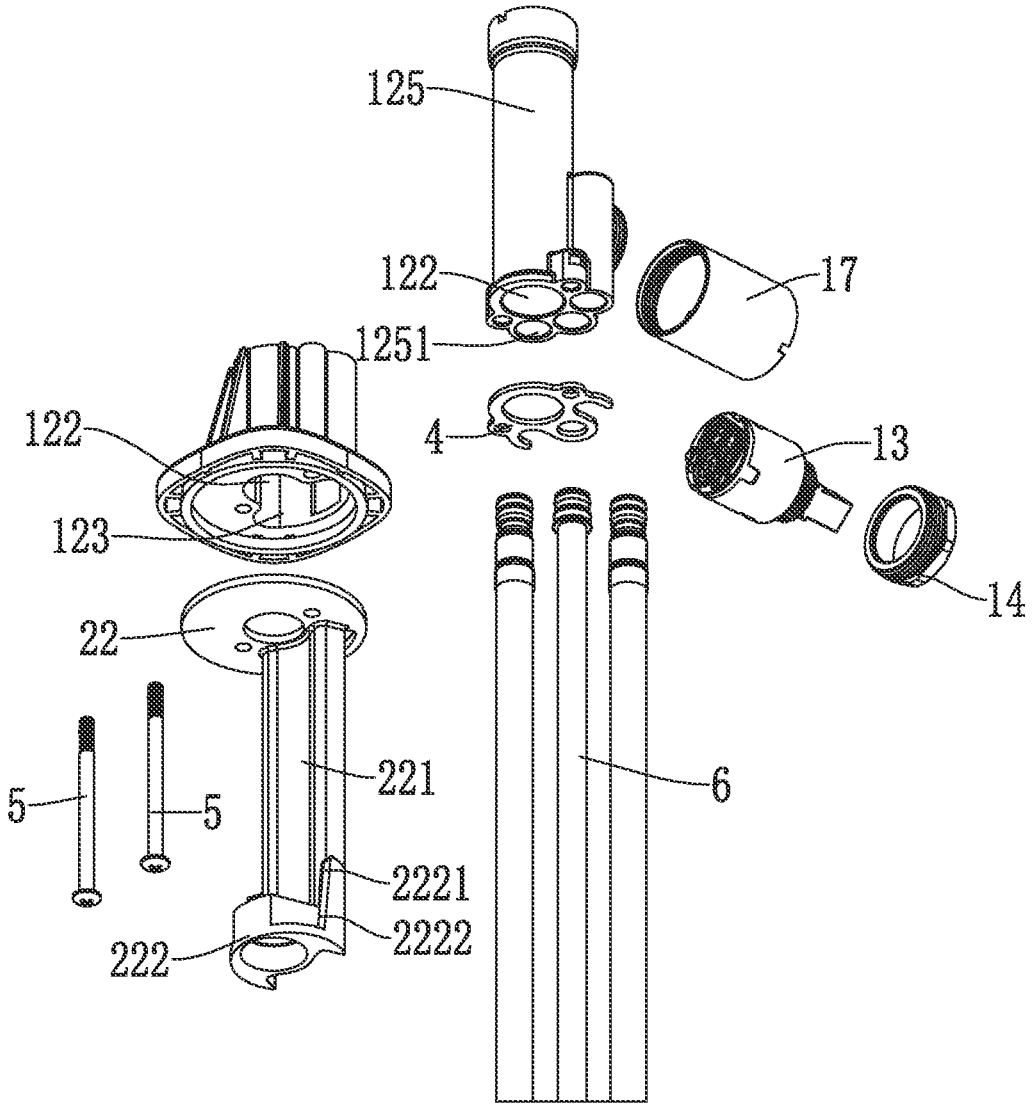
FIG. 3 is a perspective and exploded view of a support base, a support body, a pipeline structure, the locking assembly, and other components in a preferred embodiment of the present disclosure.
Figure 4:
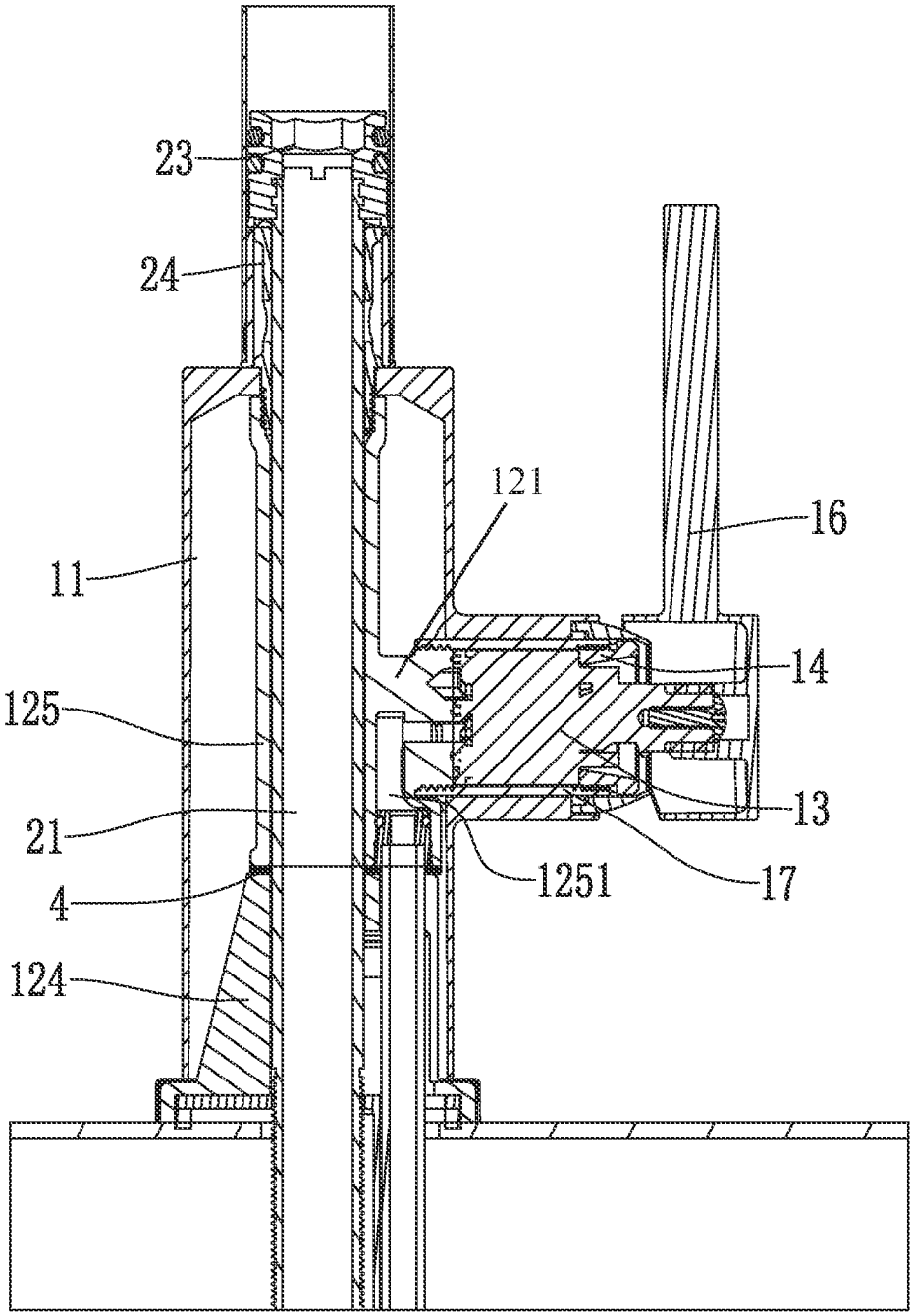
FIG. 4 is a cross-sectional view of the faucet in a preferred embodiment of the present disclosure.
Figure 5:
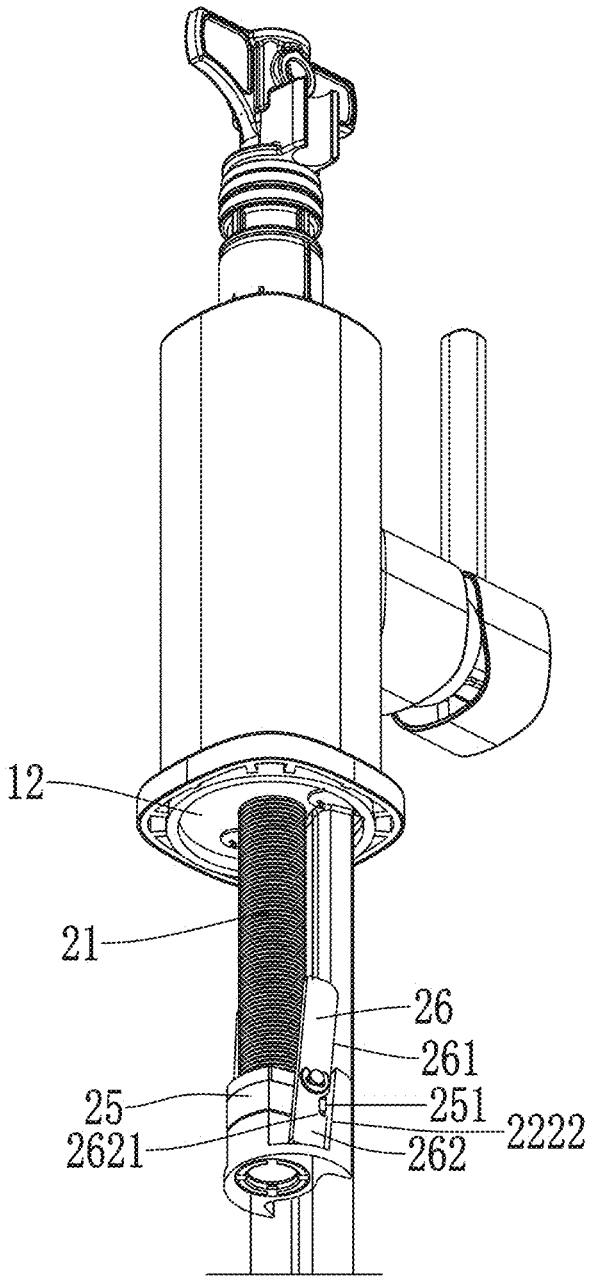
FIG. 5 is a perspective view of the faucet in a preferred embodiment of the present disclosure, showing one or more arms in a folded state.
Figure 6:
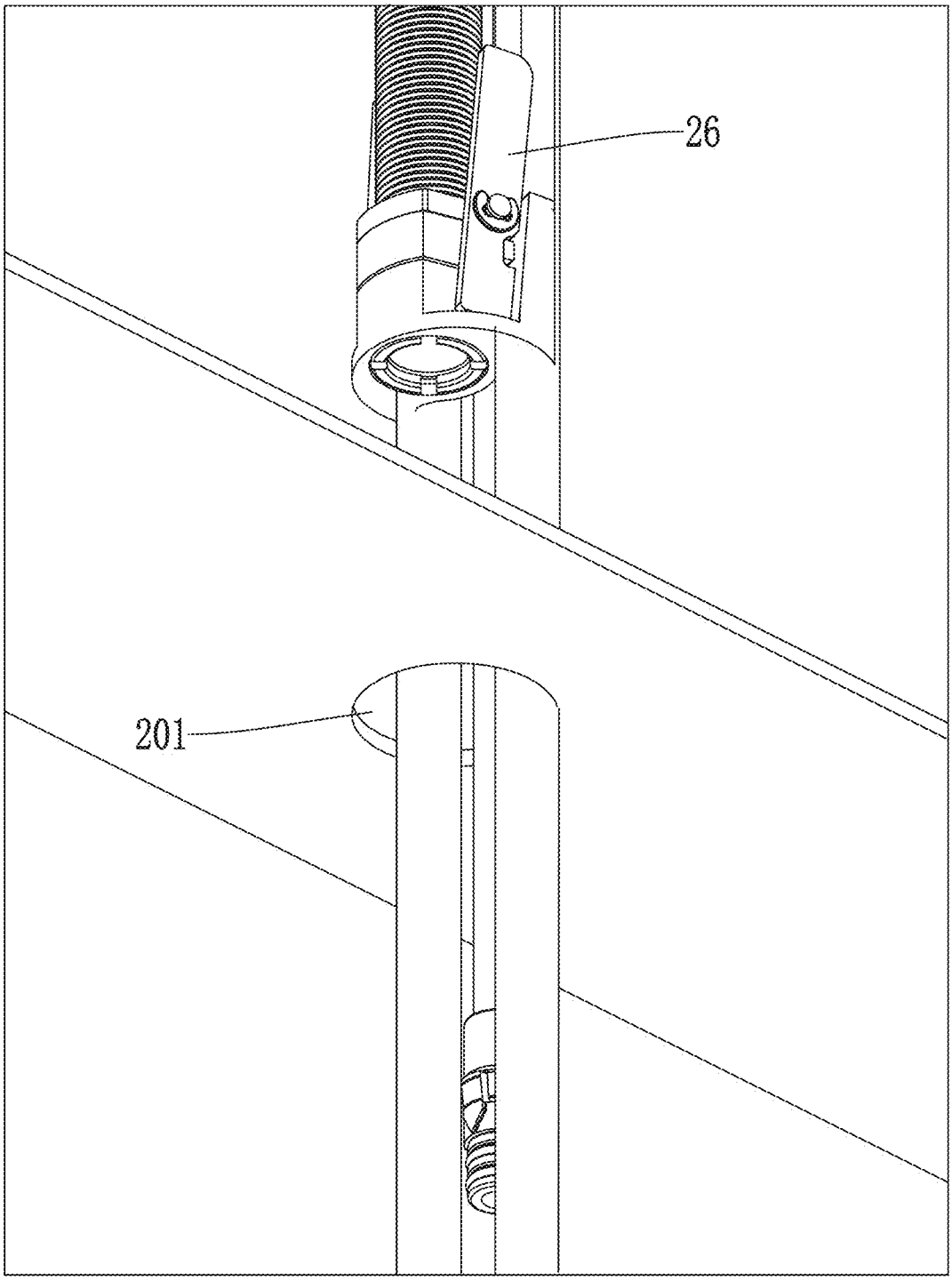
FIG. 6 is a perspective view of the faucet in a preferred embodiment of the present disclosure, showing the one or more arms in the folded state and about to be installed to a mounting hole.
Figure 7:
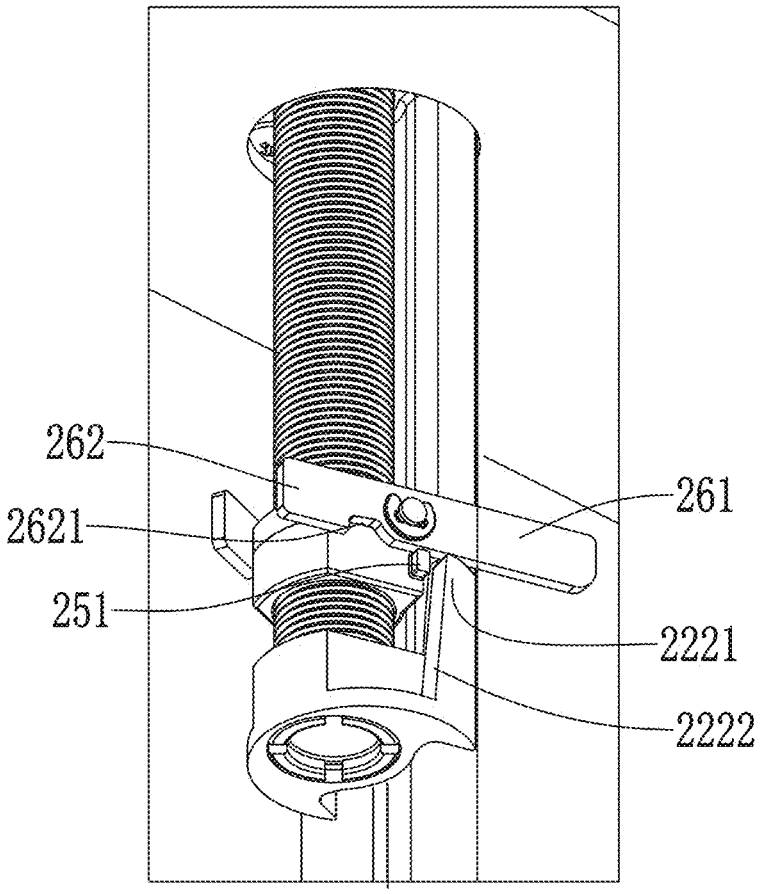
FIG. 7 is a perspective view of the faucet in the preferred embodiment of the present disclosure, showing the one or more arms having just been in an unfolded state.
Figure 8:
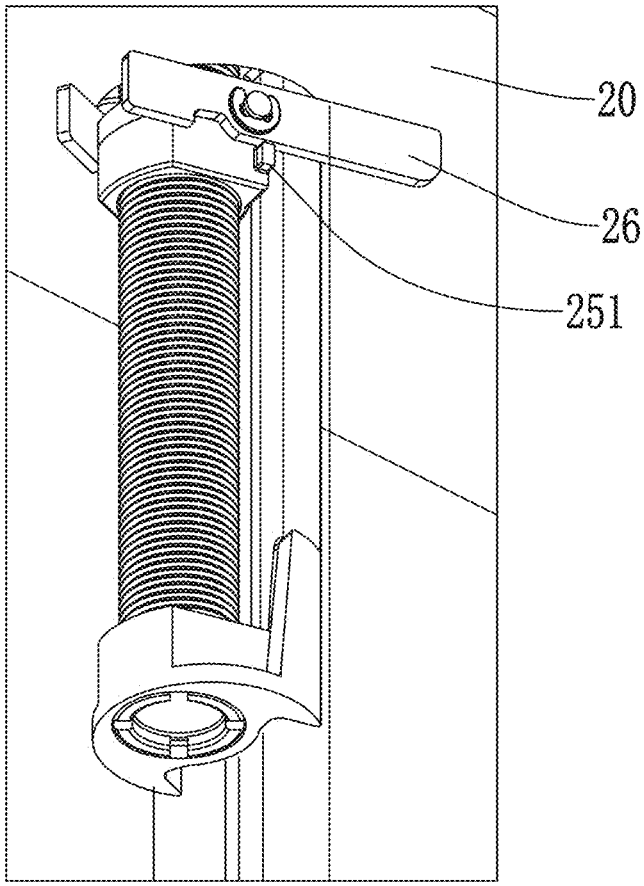
FIG. 8 is a perspective view of the faucet in the preferred embodiment of the present disclosure, showing the one or more arms are in the unfolded state and abutting a lower side of a countertop.

Referring to FIGS. 1-8, a faucet comprises a faucet body 1 and a locking assembly 2. The locking assembly 2 is connected to the faucet body 1, and the locking assembly 2 is configured to pass through a mounting hole 201 of a countertop 20. At least part of the locking assembly 2 is configured to be controlled to abut a lower side of the countertop 20.

The countertop 20 may be a worktop of a kitchen sink, etc., but the disclosure is not limited thereto. The countertop 20 comprises the mounting hole 201. The locking assembly 2 can pass through the mounting hole 201 to correspond to the lower side of the countertop 20. A user can control the locking assembly 2 above the countertop 20 to enable the locking assembly 2 to abut the lower side of the countertop 20 to achieve installation and fixation of the faucet.

The faucet body 1 comprises a faucet housing 11, a support frame 12, a valve 13, a pressing lid 14, a bent tube 15, and a handle 16. The faucet housing 11 is a three-way pipe, and a lower end of the faucet housing 11 is configured to abut an upper side of the countertop 20. The faucet housing 11 comprises a lateral opening 111, and the valve 13 is installed into the faucet housing 11 from the lateral opening 111. A lower end of the bent tube 15 is rotatably connected to an upper end of the faucet housing 11. A distal end of the bent tube 15 is disposed with a water outlet head 151. The water outlet head 151 can be a pull-out head or be fixedly connected to the distal end of the bent tube 15, but the disclosure is not limited to this regard.

The support frame 12 is disposed in the faucet housing 11. The support frame 12 is configured to be supported above the countertop 20 (i.e., the upper side of the countertop 20). The support frame 12 is connected to the locking assembly 2. The support frame 12 forms a valve seat 121 to be connected to the valve 13. The locking assembly 2 further comprises an operating member 21 rotatably disposed on the support frame 12. The operating member 21 is configured to control the locking assembly 2 to abut the lower side of the countertop 20. The support frame 12 is disposed in the faucet housing 11 and is respectively connected to the locking assembly 2 and the valve 13 to provide an overall supporting effect. As a result, a support effect of the faucet housing 11 is weakened or the faucet housing 11 does not provide the support effect. The faucet housing 11 can be made of thin-walled material or plastic, which can effectively reduce costs.

The locking assembly 2 comprises a guiding base 22, which is connected to a lower end of the support frame 12. The guiding base 22 comprises a guiding wall 221 extending along a vertical direction. The guiding wall 221 is configured to divide a lower space located under the support frame 12 into a first space 31 and a second space 32. The support frame 12 comprises an operation space 122 corresponding to the first space 31 and a pipeline space 123 corresponding to the second space 32. The operating member 21 is disposed in the first space 31 and the operation space 122, and a pipeline structure 6 of the faucet passes through the second space 32 and the pipeline space 123 to be connected to the valve seat 121. The first space 31 corresponds to the operation space 122, the operating member 21 extends through the first space 31 and the operation space 122, and the pipeline structure 6 extends through the second space 32 and the pipeline space 123. The two parts of the lower space are separated and do not interfere with or affect each other, which can effectively prevent the pipeline structure 6 from being entangled or preventing the pipeline structure 6 from affecting operation of the operating member 21. In this embodiment, the first space 31 and the operation space 122 are connected together to form an axial channel, and the operating member 21 is tubular and rotates around an axis of the operating member 21 on the axial channel.

The support frame 12 comprises a support base 124 and a support body 125. The support base 124 is configured to be supported above the countertop 20 and is fixedly connected to the guiding base 22. The faucet further comprises a pipeline pressing plate 4. The support body 125 comprises one or more pipeline sockets 1251, which are in communication with the valve seat 121. The pipeline pressing plate 4 is configured to clamp the pipeline structure 6. The support body 125 is fixedly connected to the support base 124 to fixedly clamp the pipeline pressing plate 4. When the support body 125 is connected to the support base 124, the pipeline structure 6 is correspondingly inserted into the one or more pipeline sockets 1251. The support base 124 and the support body 125 are arranged separately, and the pipeline pressing plate 4 is clamped between the support base 124 and the support body 125, which facilitates installation of the pipeline structure 6. The pipeline structure 6 is inserted into the one or more pipeline sockets 1251, which is easy and quick to install. Specifically, a lower end surface of the support base 124 and the guiding base 22 are tightly connected through one or more screws 5, and an upper end surface of the support base 124 and the lower end of the support body 125 are tightly connected through the one or more screws 5. The pipeline pressing plate 4 is fixedly clamped between the upper end surface of the support base 124 and the lower end of the support body 125, and the pipeline structure 6 penetrates through the support base 124 from the lower end surface of the support base 124 and partially extends out of the upper end surface of the support base 124. An entrance of the one or more pipeline sockets 1251 is located on the lower end of the support body 125, and when the support body 125 is correspondingly connected to the support base 124, the pipeline structure 6 is inserted into the one or more pipeline sockets 1251. During installation, the pipeline structure 6, the guiding base 22, and the support base 124 can be fixed together first, and then the support body 125 and the upper end surface of the support base 124 can be fixedly connected after being installed on the countertop 20, thereby synchronously achieving a connection between the pipeline structure 6 and the valve seat 121.

In this embodiment, the one or more screws 5 are two screws 5. The two screws 5 connect the guiding base 22, the support base 124, and the support body 125 from bottom to top.

The valve seat 121 is formed on a side wall of the support frame 12. The faucet further comprises a valve sleeve 17. The valve sleeve 17 is connected to the valve seat 121 to form a valve cavity that accommodates the valve 13. The pressing lid 14 is connected to a distal end of the valve sleeve 17 to fixedly press the valve 13. An outer wall of the valve seat 121 comprises external threads, and internal threads at one end of the valve sleeve 17 are connected to the external threads. The pressing lid 14 is connected to internal threads at a second end of the valve sleeve 17. The pressing lid 14 is not connected to the faucet housing 11 and does not affect the faucet housing 11.

An upper end of the operating member 21 extends out of an upper end of the support frame 12. The upper end of the operating member 21 is connected to an operating connector 23, and the operating member 21 is hung on the faucet housing 11 through a neck member 24 to be configured to be rotated on the faucet housing 11. The bent tube 15 can be sleeved outside the upper end of the operating member 21. The bent tube 15 is connected to the operating member 21 and is not supported on the faucet housing 11.

The locking assembly 2 comprises a connecting seat 25 and one or more arms 26 connected to two sides of the connecting seat 25. One side wall of the connecting seat 25 is in contact with and matched with the guiding wall 221. In this embodiment, the guiding wall 221 is in a concave arc shape, the connecting seat 25 is in a convex arc shape, and the guiding wall 221 and the one side wall of the connecting seat 25 are in surface-to-surface contact. When the operating member 21 is rotated, the connecting seat 25 is limited by the guiding wall 221 to be prevented from rotating to only move up and down along the guiding wall 221. The operating member 21 is threadedly connected to the connecting seat 25. The operating member 21 can be rotated to drive the connecting seat 25 to move along the guiding wall 221 so that the one or more arms 26 can abut the lower side of the countertop 20. The guiding base 22 further comprises a blocking seat 222 connected to the guiding wall 221. The one or more arms 26 are configured to be in an unfolded state and a folded state relative to the connecting seat 25. The one or more arms 26 are controlled by the operating member 21 to approach or move away from the blocking seat 222. The one or more arms 26 are in the folded state when the one or more arms 26 are adjacent to the blocking seat 222, and the one or more arms 26 are in the unfolded state when the one or more arms 26 are moved away from the blocking seat 222. A radial dimension of the one or more arms 26 in the unfolded state is larger than the mounting hole 201 of the countertop 20.

The one or more arms 26 are rotatably connected to the connecting seat 25. The one or more arms 26 are divided into a long section 261 and a short section 262 relative to a rotation point of the one or more arms 26. A length of the long section 261 is longer than that of the short section 262. The connecting seat 25 comprises a protrusion 251 located at a position of the connecting seat 25 adjacent to the long section 261. The long section 261 is turned over by gravity to drive a lower side of the long section 261 to abut the protrusion 251 so that the one or more arms 26 are in the unfolded state. The blocking seat 222 comprises a blocking block 2221. When the connecting seat 25 is moved to be adjacent to the blocking seat 222, the blocking block 2221 pushes the long section 261 so that the one or more arms 26 are in the folded state. When the blocking block 2221 abuts the long section 261 in the unfolded state, a distance between the blocking block 2221 and the rotation point of the one or more arms 26 is greater than a distance between the protrusion 251 and the rotation point of the one or more arms 26. The short section 262 further comprises a notch 2621. When the one or more arms 26 are in the folded state, the protrusion 251 corresponds to and is disposed in the notch 2621.

The blocking seat 222 further comprises an inclined surface 2222. When the one or more arms 26 is in the folded state, the short section 262 contacts the inclined surface 2222.

Figure 9:
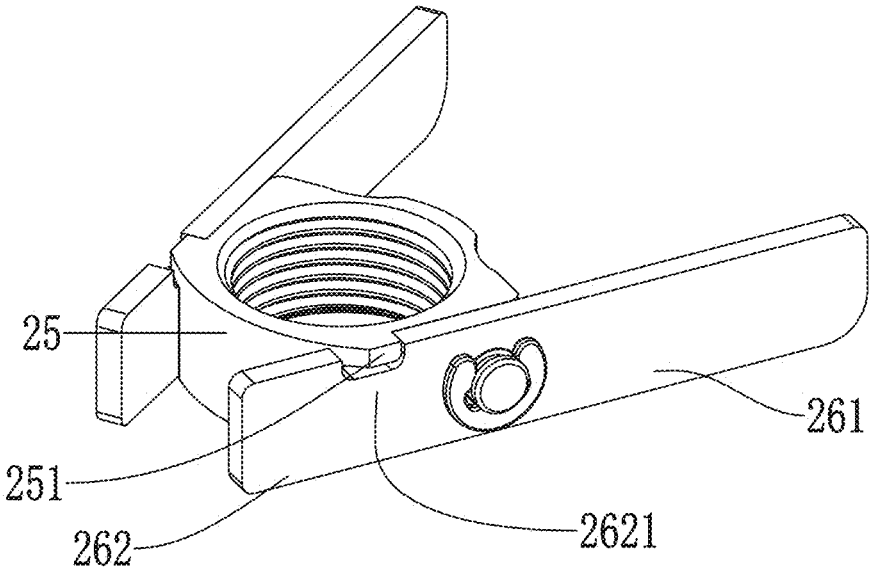
FIG. 9 is a perspective view of a connecting seat and the one or more arms in an alternative embodiment.

Referring to FIG. 9 and FIGS. 1-8, in some other embodiments, the one or more arms 26 are rotatably connected to the connecting seat 25, and the one or more arms 26 are divided into the long section 261 and the short section 262 relative to the rotation point of the one or more arms 26. The length of the long section 261 is longer than that of the short section 262. The connecting seat 25 further comprises the protrusion 251 located at the position of the connecting seat 25 adjacent to the long section 261. The long section 261 is turned over by gravity to drive an upper side of the short section 262 to abut the protrusion 251 so that the one or more arms 26 are in the unfolded state. The blocking seat 222 comprises the blocking block 2221. When the connecting seat 25 is moved to be adjacent to the blocking seat 222, the blocking block 2221 pushes against the long section 261 so that the one or more arms 26 are in the folded state. The upper side of the short section 262 further comprises the notch 2621. When the one or more arms 26 are in the unfolded state, the protrusion 251 corresponds to and is disposed in the notch 2621.

During installation, the guiding base 22, the support base 124, the pipeline pressing plate 4, the pipeline structure 6, and the support body 125 are connected in the manner described above. The connecting seat 25 is made to abut the blocking seat 222, so that the one or more arms 26 are in the folded state. The operating member 21 passes through the axial channel and the connecting seat 25 from top to bottom to be connected to a bearing component 2223 on the blocking seat 222. The operating member 21 can be rotated by manipulation of the operating connector 23 located at the upper end of the operating member 21. The operating connector 23 is an internal hexagonal socket, and the operation can be achieved by using a tool to be connected to the internal hexagonal socket. The faucet housing 11 is sleeved outside the support frame 12 from top to bottom. The lower end of the faucet housing 11 is positionally sleeved on the support base 124. The upper end of the faucet housing 11 is connected to an upper end of the support body 125 and the neck member 24 achieves sleeved positioning. The valve sleeve 17 is installed from the lateral opening 111, and the valve sleeve 17 is threadedly connected to the valve seat 121. Then the valve 13 is installed on the valve seat 121, and then fixation of the valve 13 is realized through the pressing lid 14. The valve 13 is pressed and fixed, and then the handle 16 is connected to the valve 13. The guiding base 22 passes through the mounting hole 201 from top to bottom, and then the operating member 21 is operated with the tool to rotate until the one or more arms 26 abuts the lower side of the countertop 20. Finally, the bent tube 15 is connected. In this embodiment, the operating member 21 has a hollow tubular structure. The pipeline structure 6 comprises a pull-out pipe that passes through the operating member 21 and the bent tube 15 to be connected to the water outlet head 151. The water outlet head 151 is pullably disposed at the distal end of the bent tube 15.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A faucet, comprising:

a faucet body, and a locking assembly, wherein:

the locking assembly is connected to the faucet body, the locking assembly is configured to pass through a mounting hole of a countertop, at least part of the locking assembly is configured to be controlled to abut a lower side of the countertop, the faucet body comprises a faucet housing, a support frame, and a valve, the support frame is disposed in the faucet housing, the support frame is configured to be supported on an upper side of the countertop, the support frame is connected to the locking assembly, the support frame forms a valve seat configured to be connected to the valve, the locking assembly comprises an operating member rotatably disposed on the support frame, the operating member is configured to control the locking assembly to abut the lower side of the countertop, the locking assembly comprises a guiding base, the guiding base is connected to a lower end of the support frame, the guiding base comprises a guiding wall extending along a vertical direction, the locking assembly comprises a connecting seat and one or more arms connected to two sides of the connecting seat, one side wall of the connecting seat is in contact with and matched with the guiding wall, the operating member is threadedly connected to the connecting seat, and the operating member is configured to be rotated to drive the connecting seat to move along the guiding wall so that the one or more arms abut the lower side of the countertop.

2. The faucet according to claim 1, wherein:

the guiding wall is configured to divide a lower space located under the support frame into a first space and a second space, the support frame comprises an operation space corresponding to the first space and a pipeline space corresponding to the second space, the operating member is disposed in the first space and the operation space, and a pipeline structure of the faucet is configured to pass through the second space and the pipeline space to be connected to the valve seat.

3. The faucet according to claim 2, wherein:

the support frame comprises a support base and a support body, the support base is configured to be supported on the upper side of the countertop and is fixedly connected to the guiding base, the faucet comprises a pipeline pressing plate, the support body comprises one or more pipeline sockets, the one or more pipeline sockets are in communication with the valve seat, the pipeline pressing plate is configured to clamp the pipeline structure, the support body is fixedly connected to the support base to fixedly clamp the pipeline pressing plate, and when the support body is connected to the support base, the pipeline structure is correspondingly disposed in the one or more pipeline sockets.

4. The faucet according to claim 1, wherein:

the valve seat is formed on a side wall of the support frame, the faucet comprises a valve sleeve, the valve sleeve is connected to the valve seat to form a valve cavity to accommodate the valve, the faucet comprises a pressing lid, and the pressing lid is connected to a distal end of the valve sleeve to fixedly press the valve.

5. The faucet according to claim 1, wherein:

the operating member is tubular, an upper end of the operating member extends out of an upper end of the support frame, the upper end of the operating member is connected to an operating connector, and the operating member is hung on the faucet housing through a neck member to be configured to be rotated on the faucet housing.

6. The faucet according to claim 1, wherein:

the guiding base further comprises a blocking seat connected to the guiding wall, the one or more arms are configured to be in an unfolded state and a folded state relative to the connecting seat, the one or more arms are controlled by the operating member to approach or move away from the blocking seat, the one or more arms are in the folded state when the one or more arms are adjacent to the blocking seat, the one or more arms are in the unfolded state when the one or more arms are moved away from the blocking seat, and a radial dimension of the one or more arms in the unfolded state is larger than the mounting hole of the countertop.

7. The faucet according to claim 6, wherein:

the one or more arms are rotatably connected to the connecting seat, the one or more arms are divided into a long section and a short section relative to a rotation point of the one or more arms, a length of the long section is longer than a length of the short section, the connecting seat comprises a protrusion located at a position of the connecting seat adjacent to the long section, the long section is turned over by gravity to drive a lower side of the long section to abut the protrusion so that the one or more arms are in the unfolded state, the blocking seat comprises a blocking block, when the connecting seat is moved to be adjacent to the blocking seat, the blocking block pushes the long section so that the one or more arms are in the folded state, and when the blocking block abuts the long section in the unfolded state, a distance between the blocking block and the rotation point of the one or more arms is greater than a distance between the protrusion and the rotation point of the one or more arms.

8. The faucet according to claim 7, wherein:

a lower side of the short section comprises a notch, and when the one or more arms are in the folded state, the protrusion corresponds to and is disposed in the notch.

9. The faucet according to claim 6, wherein:

the one or more arms are rotatably connected to the connecting seat, the one or more arms are divided into a long section and a short section relative to a rotation point of the one or more arms, a length of the long section is longer than a length of the short section, the connecting seat further comprises a protrusion located at a position of the connecting seat adjacent to the long section, the long section is turned over by gravity to drive an upper side of the short section to abut the protrusion so that the one or more arms are in the unfolded state, the blocking seat comprises a blocking block, and when the connecting seat is moved to be adjacent to the blocking seat, the blocking block pushes against the long section so that the one or more arms are in the folded state.

10. The faucet according to claim 9, wherein:

the upper side of the short section comprises a notch, and when the one or more arms are in the unfolded state, the protrusion corresponds to and is disposed in the notch.

11. The faucet according to claim 9, wherein:

the blocking seat further comprises an inclined surface, and when the one or more arms are in the folded state, the short section abuts the inclined surface.

12. The faucet according to claim 7, wherein:

the blocking seat further comprises an inclined surface, and when the one or more arms are in the folded state, the short section abuts the inclined surface.

13. A faucet, comprising:

a faucet body, and a locking assembly, wherein:

the locking assembly is connected to the faucet body, the locking assembly is configured to pass through a mounting hole of a countertop, at least part of the locking assembly is configured to be controlled to abut a lower side of the countertop, the faucet body comprises a faucet housing, a support frame, and a valve, the support frame is disposed in the faucet housing, the support frame is configured to be supported on an upper side of the countertop, the support frame is connected to the locking assembly, the support frame forms a valve seat configured to be connected to the valve, the locking assembly comprises an operating member rotatably disposed on the support frame, the operating member is configured to control the locking assembly to abut the lower side of the countertop, the locking assembly comprises a guiding base, the guiding base is connected to a lower end of the support frame, the guiding base comprises a guiding wall extending along a vertical direction, the guiding wall is configured to divide a lower space located under the support frame into a first space and a second space, the support frame comprises an operation space corresponding to the first space and a pipeline space corresponding to the second space, the operating member is disposed in the first space and the operation space, and a pipeline structure of the faucet is configured to pass through the second space and the pipeline space to be connected to the valve seat.

14. The faucet according to claim 13, wherein:

the support frame comprises a support base and a support body, the support base is configured to be supported on the upper side of the countertop and is fixedly connected to the guiding base, the faucet comprises a pipeline pressing plate, the support body comprises one or more pipeline sockets, the one or more pipeline sockets are in communication with the valve seat, the pipeline pressing plate is configured to clamp the pipeline structure, the support body is fixedly connected to the support base to fixedly clamp the pipeline pressing plate, and when the support body is connected to the support base, the pipeline structure is correspondingly disposed in the one or more pipeline sockets.

15. The faucet according to claim 13, wherein:

the valve seat is formed on a side wall of the support frame, the faucet comprises a valve sleeve, the valve sleeve is connected to the valve seat to form a valve cavity to accommodate the valve, the faucet comprises a pressing lid, and the pressing lid is connected to a distal end of the valve sleeve to fixedly press the valve.

16. The faucet according to claim 13, wherein:

the operating member is tubular, an upper end of the operating member extends out of an upper end of the support frame, the upper end of the operating member is connected to an operating connector, and the operating member is hung on the faucet housing through a neck member to be configured to be rotated on the faucet housing.

17. A faucet, comprising:

a faucet body, a locking assembly, a valve sleeve, and a pressing lid, wherein:

the locking assembly is connected to the faucet body, the locking assembly is configured to pass through a mounting hole of a countertop, at least part of the locking assembly is configured to be controlled to abut a lower side of the countertop, the faucet body comprises a faucet housing, a support frame, and a valve, the support frame is disposed in the faucet housing, the support frame is configured to be supported on an upper side of the countertop, the support frame is connected to the locking assembly, the support frame forms a valve seat configured to be connected to the valve, the locking assembly comprises an operating member rotatably disposed on the support frame, the operating member is configured to control the locking assembly to abut the lower side of the countertop, the valve seat is formed on a side wall of the support frame, the valve sleeve is connected to the valve seat to form a valve cavity to accommodate the valve, and the pressing lid is connected to a distal end of the valve sleeve to fixedly press the valve.

18. A faucet, comprising:

a faucet body, and a locking assembly, wherein:

the locking assembly is connected to the faucet body, the locking assembly is configured to pass through a mounting hole of a countertop, at least part of the locking assembly is configured to be controlled to abut a lower side of the countertop, the faucet body comprises a faucet housing, a support frame, and a valve, the support frame is disposed in the faucet housing, the support frame is configured to be supported on an upper side of the countertop, the support frame is connected to the locking assembly, the support frame forms a valve seat configured to be connected to the valve, the locking assembly comprises an operating member rotatably disposed on the support frame, the operating member is configured to control the locking assembly to abut the lower side of the countertop, the operating member is tubular, an upper end of the operating member extends out of an upper end of the support frame, the upper end of the operating member is connected to an operating connector, and the operating member is hung on the faucet housing through a neck member to be configured to be rotated on the faucet housing.

* * * * *